US010752036B2

(12) United States Patent
Bergstedt

(10) Patent No.: US 10,752,036 B2
(45) Date of Patent: Aug. 25, 2020

(54) DYE SUBLIMATION-RECEPTIVE TRANSFER FILM

(71) Applicant: Ikonics Corporation, Duluth, MN (US)

(72) Inventor: Troy Bergstedt, Esko, MN (US)

(73) Assignee: Ikonics Corporation, Duluth, MN (US)

( * ) Notice: Subject to any disclaimer, the term of this patent is extended or adjusted under 35 U.S.C. 154(b) by 0 days.

(21) Appl. No.: 15/845,732

(22) Filed: Dec. 18, 2017

(65) Prior Publication Data

US 2018/0171547 A1 Jun. 21, 2018

Related U.S. Application Data

(63) Continuation of application No. PCT/US2017/066644, filed on Dec. 15, 2017.

(60) Provisional application No. 62/435,456, filed on Dec. 16, 2016.

(51) Int. Cl.
*B41M 5/035* (2006.01)
*B41M 5/52* (2006.01)
*D06P 5/28* (2006.01)

(52) U.S. Cl.
CPC ..... *B41M 5/0355* (2013.01); *B41M 5/5227* (2013.01); *B41M 5/5254* (2013.01); *D06P 5/004* (2013.01); *D06P 5/005* (2013.01); *B41M 2205/02* (2013.01)

(58) Field of Classification Search
CPC ..... B41M 5/035; B41M 5/50; B41M 5/562; B41M 2205/02; B41M 2205/03; B41M 2205/38; B41M 2205/40; D06P 5/004
USPC ..... 503/227
See application file for complete search history.

(56) References Cited

U.S. PATENT DOCUMENTS 3,480,463 A 11/1969 Rankin et al.
5,069,944 A 12/1991 Murakami et al.
5,218,019 A 6/1993 Kushi et al.
5,580,410 A 12/1996 Johnston et al.
6,103,042 A * 8/2000 Hatada ..... B41M 5/443 156/235
6,673,744 B1 * 1/2004 Taguchi ..... B41M 5/38257 503/227
7,081,324 B1 7/2006 Hare et al.

OTHER PUBLICATIONS

International Search Report and Written Opinion for PCT Application No. PCT/US2017/066644 dated Feb. 21, 2018 (9 pages).
International Preliminary Report on Patentability for PCT Application No. PCT/US2017/066644 dated Jun. 27, 2019 (7 pages).

* cited by examiner

*Primary Examiner* — Gerard Higgins
(74) *Attorney, Agent, or Firm* — Pauly, DeVries Smith & Deffner LLC

(57) ABSTRACT

The present application is directed to a transferable film for dye sublimation, the film comprising, in an example implementation, a carrier film; and a dye sublimation-receptive layer comprising a base resin that undergoes crosslinking at elevated temperatures. In an example implementation, the dye sublimation-receptive layer comprises an acrylic copolymer with acrylate reactive groups. Methods of using the transferrable film to create a dye sublimation-receptive surface are also provided, as are substrates having a substantially non-receptive to dye sublimation inks onto which is formed a thermally crosslinked layer to the substrate surface.

22 Claims, 2 Drawing Sheets

DYE SUBLIMATION-RECEPTIVE TRANSFER FILM

This application claims priority to U.S. Provisional Application No. 62/435,456, filed Dec. 16, 2016, and International Application PCT/US2017/066644, filed Dec. 15, 2017, the contents of which are herein incorporated by reference in their entirety.

FIELD OF THE INVENTION

The present application relates to dye sublimation-receptive films. More specifically, the application relates to transferrable films to make a substrate receptive to dye sublimation inks.

BACKGROUND

Dye sublimation printing processes involve special inks that are transferred to substrates at elevated temperatures. The special inks are printed on transfer paper, and this transfer paper is then applied to a print-receptive surface of a substrate. Pressure is applied to the transfer paper to maintain registration of the transfer paper on the print-receptive substrate. Heat is also applied to cause the inks to sublime to a vaporized state. The vaporized inks then travel from the transfer paper to the surface of the print-receptive substrate, where the inks are absorbed and retained, thereby creating a durable image on the substrate.

A key aspect of dye sublimation processes is that the inks which form the transferred image are absorbed into the receiving substrate surface, rather than being deposited onto the top of the surface. This absorption into the substrate imparts increased durability to the printed image that is difficult to obtain with many other printing processes.

Not all surfaces are suitable for receiving dye sublimation inks. Polyester is a typical substrate material used in dye sublimation printing, as it is tolerant of dye sublimation temperatures—typically approximately 200 degrees Celsius—and allows the gaseous dyes to penetrate into the body of the resin. Many other materials are not inherently dye sublimation-receptive without some type of surface modification/coating—glass, acrylic, metal, stone, ceramic, wood, natural fibers (e.g. cotton). Precoated materials are available to enable dye sub printing, but typically these are available in limited selection and usually large minimum quantities are required for production. There are currently options available in the market for users to apply dye sublimation-receptive coatings to individual substrates by spraying, brushing or dipping, but these often give variable quality, consistency and thickness and may require specialized equipment, multiple steps and time to cure/dry.

A need remains, however, for a product and process that can economically and efficiently produce a high-quality dye sublimation-receptive surface on a variety of substrates that are otherwise not suitable for dye sublimation printing.

SUMMARY OF THE INVENTION

The present application is directed to a transferable film for dye sublimation. The film comprises, in an example implementation, a carrier film and a dye sublimation-receptive layer. The dye sublimation-receptive layer includes a base resin that undergoes crosslinking at elevated temperatures. In an example implementation the dye sublimation-receptive layer contains an acrylic copolymer with acrylate reactive groups.

In some constructions the dye sublimation-receptive layer further comprises a thermal initiator, such as an initiator having a half-life of less than 10 seconds at 200 degrees C.

In some embodiments the dye sublimation-receptive layer is at least 0.5 mils thick; and is often less than 5 mils thick. In an example construction the dye sublimation-receptive layer is from 1 to 2.5 mils thick. In some constructions the dye sublimation-receptive layer is from 0.5 to 10 mils thick; alternatively from 0.5 to 7.5 mils thick, alternatively from 0.5 to 5 mils thick, alternatively from 0.25 to 2.5 mils thick; alternatively from 0.25 to 10 mils thick, alternatively from 0.25 to 7.5 mils thick, alternatively from 0.25 to 5 mils thick, alternatively from 0.25 to 2.5 mils thick; alternatively less than 10 mils thick, alternatively less than 7.5 mils thick, alternatively less than 5 mils thick, alternatively less than 2.5 mils thick.

The transferrable film can include a pigment, in particular a pigment in the dye sublimation layer or an adjacent layer. White pigments are particularly useful because they provide a background for full color dye sublimation printing.

The carrier film should generally be able to withstand elevated temperatures. The carrier film typically can comprise, for example, PET. The carrier film can include a surface texture for imparting a surface property to the dye sublimation-receptive layer, such as a gloss or matte surface. The carrier film is generally from 2 to 6 mils thick, but can also be less than 2 mils thick or be greater than 6 mils thick.

In some implementations the transferable film includes a release control layer intermediate the carrier film and the dye sublimation-receptive layer. The release control layer increases adhesion between the carrier film and the dye sublimation-receptive layer in some embodiments, and decreases adhesion between the carrier film and the dye sublimation-receptive layer in other embodiments.

The transferable film can include a protective layer between the carrier film and the dye sublimation receptive layer. In some constructions the transferable film includes an adhesive layer positioned on the dye sublimation-receptive layer. This adhesive layer can be thermally curable. A slip-sheet can be provided to prevent sticking.

Methods of using the transferrable film to create a dye sublimation-receptive surface include providing a surface that is substantially non-receptive to dye sublimation inks. A film comprising a carrier layer and a thermally-crosslinkable film is applied to the substrate, followed by applying heat and pressure to the film at a temperature above 175 degrees C. Thereafter the carrier film is removed and the surface is now ready for transfer of a dye sublimation ink. In this manner a substrate on a surface that is substantially non-receptive to dye sublimation inks is formed into a surface that is receptive to dye sublimation inks by adding a thermally crosslinked layer to the substrate surface.

This summary is an overview of some of the teachings of the present application and is not intended to be an exclusive or exhaustive treatment of the present subject matter. Further details are found in the detailed description and appended claims. Other aspects will be apparent to persons skilled in the art upon reading and understanding the following detailed description and viewing the drawings that form a part thereof, each of which is not to be taken in a limiting sense. The scope herein is defined by the appended claims and their legal equivalents.

BRIEF DESCRIPTION OF THE FIGURES

Aspects may be more completely understood in connection with the following figures, in which.

Figures 1A, 1B:
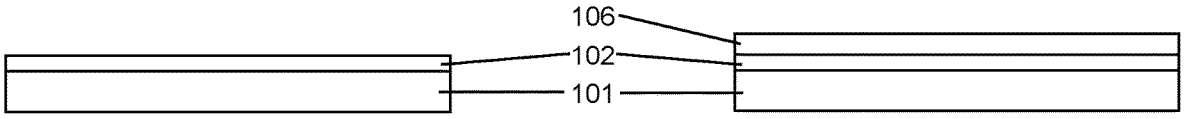
FIG. 1A is an example dye sublimation-receptive transfer film made in accordance with the present disclosure, showing a dye sublimation receptive layer and a carrier layer.
FIG. 1B is the transfer film of FIG. 1A, showing with a slipsheet.
Figures 2A, 2B:
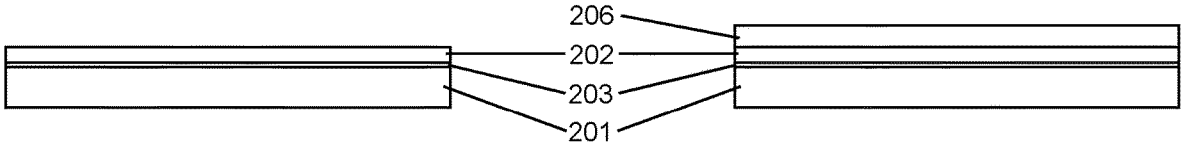
FIG. 2A is a dye sublimation-receptive transfer film made in accordance with the present disclosure, showing a dye sublimation receptive layer, a carrier layer, and a release control layer.
FIG. 2B is the transfer film of FIG. 2A, showing with a slipsheet.
Figures 3A, 3B:
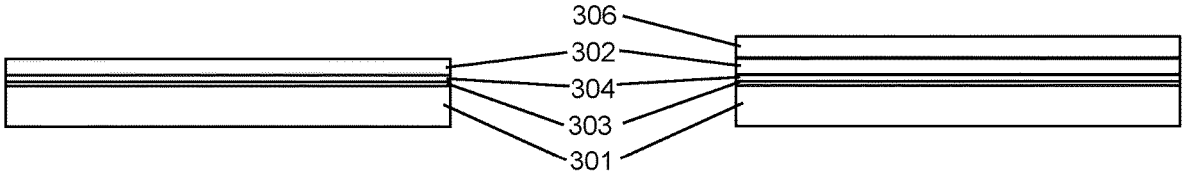
FIG. 3A is a dye sublimation-receptive transfer film made in accordance with the present disclosure, showing a dye sublimation receptive layer, a carrier layer, a release control layer, and an optional protective layer.
FIG. 3B is the transfer film of FIG. 3A, showing with a slipsheet.
Figures 4A, 4B:
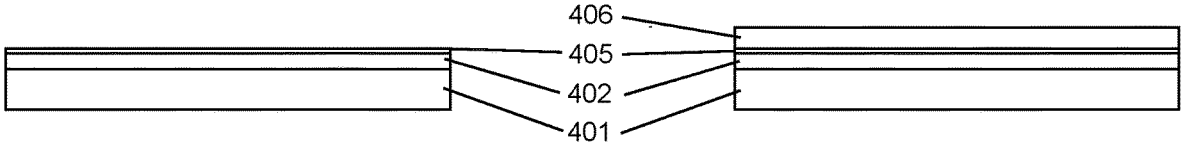
FIG. 4A is a dye sublimation-receptive transfer film made in accordance with the present disclosure, showing a dye sublimation receptive layer, a carrier layer, and an optional color/effect layer.
FIG. 4B is the transfer film of FIG. 4A, showing with a slipsheet.
Figures 5A, 5B:
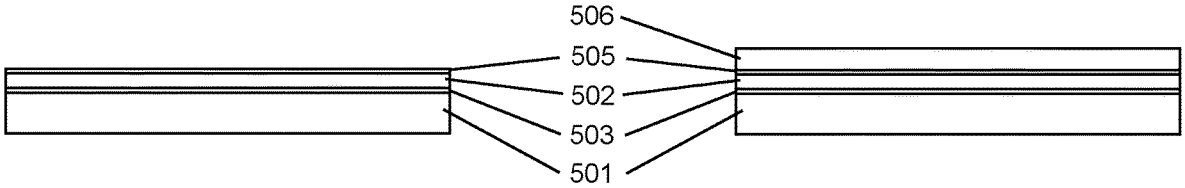
FIG. 5A is a dye sublimation-receptive transfer film made in accordance with the present disclosure, showing a dye sublimation receptive layer, a carrier layer, a release control layer, and a color/effect layer.
FIG. 5B is the transfer film of FIG. 5A, showing with a slipsheet.
Figures 6A, 6B:
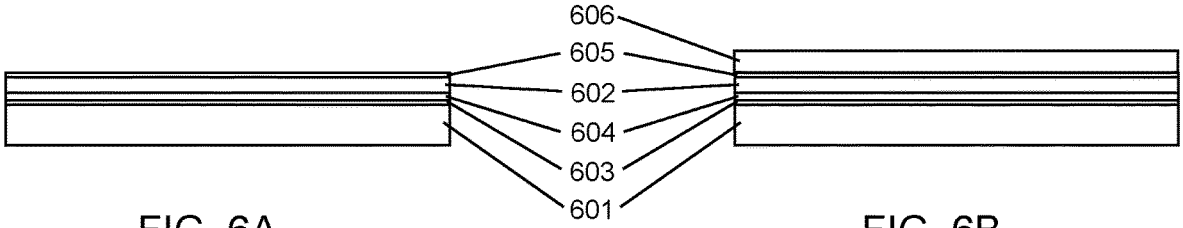
FIG. 6A is a dye sublimation-receptive transfer film made in accordance with the present disclosure, showing a carrier layer, a dye sublimation-receptive layer, a release control layer, a protective layer, and a color/effect layer
FIG. 6B is the transfer film of FIG. 6A, showing with a slipsheet.
Figure 7A:
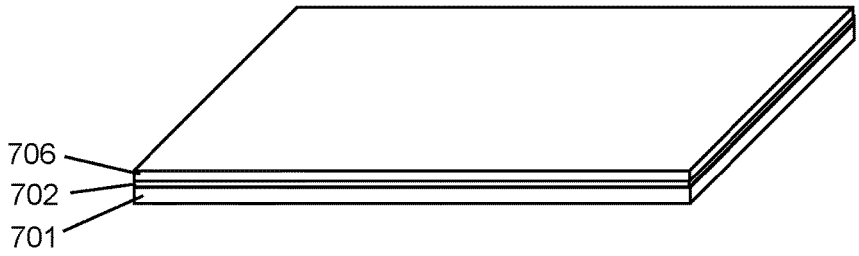
FIG. 7A is a dye sublimation-receptive transfer film made in accordance with the present disclosure, shown with a showing a dye sublimation receptive layer, a carrier layer, and a slipsheet.
Figure 7B:
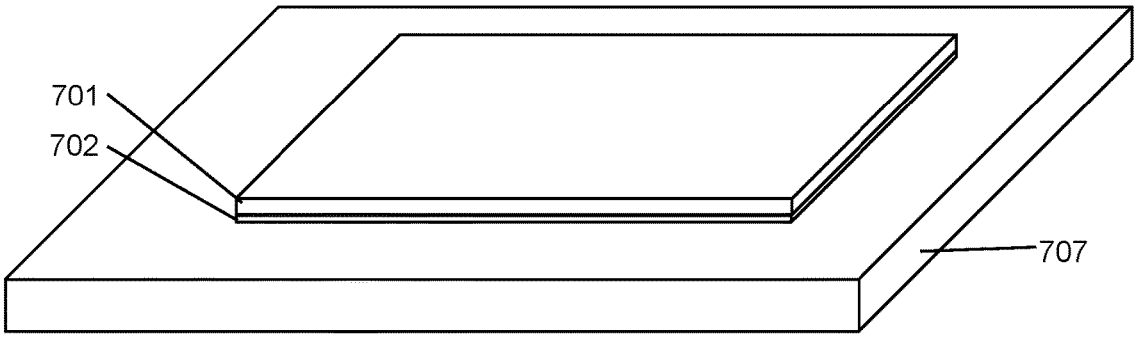
FIG. 7B is a dye sublimation-receptive transfer film made in accordance with the present disclosure, showing the film applied to a substrate following removal of the slipsheet.
Figure 7C:
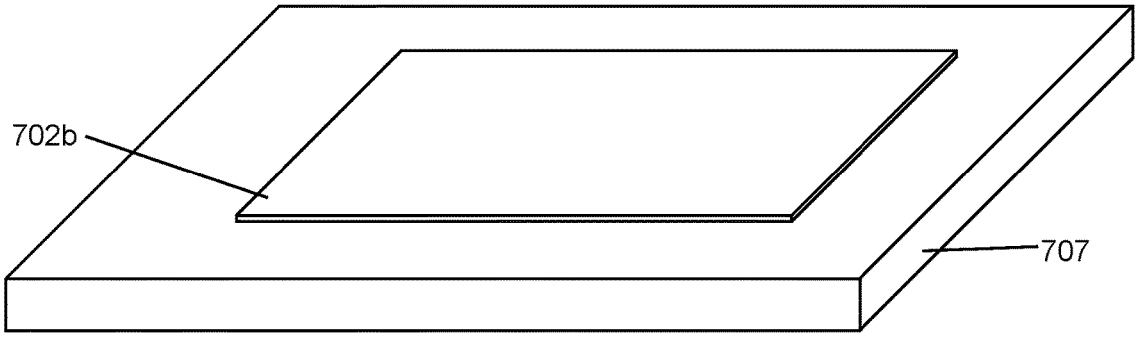
FIG. 7C is the substrate of FIG. 7B, with the dye sublimation-receptive film applied, cured and hardened and the carrier layer removed.
Figure 7D:
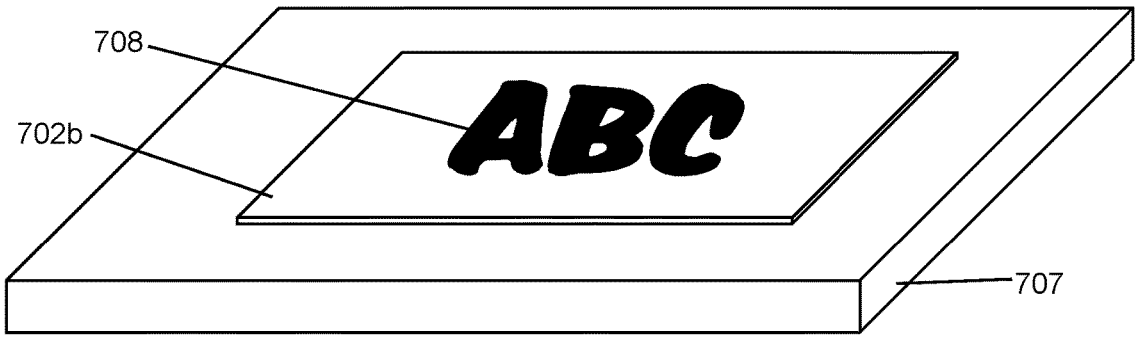
FIG. 7D is the substrate of FIG. 7C, with the letters "ABC" printed on the cured and hardened dye sublimation-receptive film.

While embodiments are susceptible to various modifications and alternative forms, specifics thereof have been shown by way of example and drawings, and will be described in detail. It should be understood, however, that the scope herein is not limited to the embodiments described. On the contrary, the intention is to cover modifications, equivalents, and alternatives falling within the spirit and scope herein.

DETAILED DESCRIPTION

The present application is directed to a transferable film for dye sublimation. The film comprises, in an example implementation, a carrier film and a dye sublimation-receptive layer. The dye sublimation-receptive layer includes a base resin that undergoes crosslinking at elevated temperatures.

In an example implementation the dye sublimation-receptive layer contains an acrylic copolymer with acrylate reactive groups. Suitable acrylic copolymers include, for example, Lumicryl U-721S, from Estron Chemical. The amount of base resin is typically at least 30 percent by weight of the dye sublimation-receptive layer, optionally at least 40 percent by weight of the dye sublimation-receptive layer, at least 50 percent by weight of the dye sublimation-receptive layer, at least 60 percent by weight of the dye sublimation-receptive layer. In some implementations the amount of base resin is less than 80 percent by weight of the dye sublimation-receptive layer, optionally less than 70 percent by weight of the dye sublimation-receptive layer, optionally less than 60 percent by weight of the dye sublimation-receptive layer; optionally less than 80 percent by weight of the dye sublimation-receptive layer. In certain implementations the amount of basis resin in the dye sublimation-receptive layer is 30 to 80 percent by weight of the dye sublimation-receptive layer; alternatively the amount of basis resin in the dye sublimation-receptive layer is 40 to 70 percent by weight of the dye sublimation-receptive layer; the amount of basis resin in the dye sublimation-receptive layer is 45 to 65 percent by weight of the dye sublimation-receptive layer; the amount of basis resin in the dye sublimation-receptive layer is 50 to 65 percent by weight of the dye sublimation-receptive layer; or the amount of basis resin in the dye sublimation-receptive layer is 50 to 60 percent by weight of the dye sublimation-receptive layer.

A solvent, such as methyl ethyl ketone can be added, such as in quantities of 10 to 25 percent by weight of the dye sublimation-receptive layer; optionally 10 to 25 percent by weight of the dye sublimation-receptive layer; 13 to 22 percent by weight of the dye sublimation-receptive layer; 15 to 20 percent by weight of the dye sublimation-receptive layer; or 19 to 20 percent by weight of the dye sublimation-receptive layer. In some implementations, such as when a titanium dioxide is added to make a white layer, the methyl ethyl ketone can comprise from 20 to 50 percent by weight of the dye sublimation-receptive layer, commonly 20 to 40 percent, or 25 to 35 percent. In some implementations the MEK is less than 40 percent, less than 35 percent, less than 30 percent, less than 25 percent, or less than 20 percent by weight of the dye sublimation-receptive layer. When titanium dioxide is used, it can be, for example 2 to 20, 5 to 15, 8 to 12, less than 20, less than 15, less than 10, less than 5, greater than 1, greater than 2, greater than 4, greater than 5, greater than 8 or greater than 10 percent of the dyesublimation-receptive layer.

An acrylate, such as a polyester acrylate, such as CN2283 by Sartomer, can be included, typically at a level of less 15 percent by weight of the dye sublimation receptive layer; typically less than 12 percent by weight of the dye sublimation-receptive layer; typically less than 13 percent by weight of the dye sublimation-receptive layer; typically less than 11 percent by weight of the dye sublimation-receptive layer; optionally less than 10 percent by weight of the dye sublimation-receptive layer. Generally, the acrylate is at least 5 percent by weight of the dye sublimation-receptive layer; is at least 6 percent by weight of the dye sublimation-receptive layer; is at least 7 percent by weight of the dye sublimation-receptive layer or is at least 8 percent by weight of the dye sublimation-receptive layer.

An adhesion promoter, such as PL-223 form PL Industries can be added to the dye sublimation-receptive layer, typically at a level of about 1 to 5 weight percent, 2 to 4 weight percent, less than 4 weight percent, more than 2 weight percent, or about 3 weight percent of the dye sublimation-receptive layer.

The initiator, such as benzoyl peroxide, can be present in quantities of less than 10 percent, more commonly less than 8 percent, or less than 6 percent of the dye sublimation-receptive layer.

The present application addresses the convenience and quality issues in preparing an otherwise non-print-receptive substrate to be dye sublimation printed.

A coated sublimation-receptive film construction in sheet and/or roll format provides controlled, consistent thickness, a defined application area, and no requirements for specialized application procedures or equipment. Application of the sublimation-receptive film by hot lamination uses the same equipment and procedures as used during typical dye sublimation printing. The film is applied to the substrate and cured using heat and pressure to impart adhesion, durability, controlled gloss and water- and chemical resistance.

The coated film comprises, in an example implementation, a base resin with reactive chemical functionality which undergoes crosslinking in the presence of a thermal initiator and sufficient temperature. In some example implementations this temperature is the same as the temperature used during dye sublimation. A relatively low melting point of the unreacted base resin is acceptable, as long as the melting point of the cured film is greater than the dye sublimation temperature. The base resin may be an acrylic copolymer with acrylate reactive groups or other reactive polymer/copolymer types.

In some constructions the melting point of the coated film is selected in order to balance an initial melt and flow with subsequent hardening as activation temperatures are reached. The initial melt allows for migration of the thermal initiator and molecular alignment of the resin to facilitate the crosslinking reactions, leveling and filling of small voids in porous or roughened substrates, and a tapered edge where the film is applied.

The dye sublimation-receptive layer includes a base resin that undergoes crosslinking at elevated temperatures. In an example implementation the dye sublimation-receptive layer contains an acrylic copolymer with acrylate reactive groups. In some constructions the dye sublimation-receptive layer further comprises a thermal initiator, such as an initiator having a half-life of less than 10 seconds at 200 degrees C.

In some embodiments the dye sublimation-receptive layer is at least 0.5 mils thick; and is often less than 5 mils thick. In an example construction the dye sublimation-receptive layer is from 1 to 2.5 mils thick. In some constructions the dye sublimation-receptive layer is from 0.5 to 10 mils thick; alternatively from 0.5 to 7.5 mils thick, alternatively from 0.5 to 5 mils thick, alternatively from 0.25 to 2.5 mils thick; alternatively from 0.25 to 10 mils thick, alternatively from 0.25 to 7.5 mils thick, alternatively from 0.25 to 5 mils thick, alternatively from 0.25 to 2.5 mils thick; alternatively less than 10 mils thick, alternatively less than 7.5 mils thick, alternatively less than 5 mils thick, alternatively less than 2.5 mils thick.

The transferrable film can include a pigment, in particular a pigment in the dye sublimation layer or an adjacent layer. White pigments are particularly useful because they provide a background for full color dye sublimation printing.

The carrier film should generally be able to withstand elevated temperatures. The carrier film typically can comprise, for example, PET. The carrier film can include a surface texture for imparting a surface property to the dye sublimation-receptive layer, such as a gloss or matte surface. The carrier film is generally from 2 to 6 mils thick, but can also be less than 2 mils thick or be greater than 6 mils thick.

In some implementations the transferable film includes a release control layer intermediate the carrier film and the dye sublimation-receptive layer. The release control layer increases adhesion between the carrier film and the dye sublimation-receptive layer in some embodiments, and decreases adhesion between the carrier film and the dye sublimation-receptive layer in other embodiments.

The transferable film can include a protective layer between the carrier film and the dye sublimation receptive layer. In some constructions the transferable film includes an adhesive layer positioned on the dye sublimation-receptive layer. This adhesive layer can be thermally curable. A slip-sheet can be provided to prevent sticking of the transferrable films.

Methods of using the transferrable film to create a dye sublimation-receptive surface include providing a surface that is substantially non-receptive to dye sublimation inks. A film comprising a carrier layer and a thermally-crosslinkable film is applied to the substrate, followed by applying heat and pressure to the film at a temperature above 175 degrees C. Thereafter the carrier film is removed and the surface is now ready for transfer of a dye sublimation ink. In this manner a substrate on a surface that is substantially non-receptive to dye sublimation inks is formed into a surface that is receptive to dye sublimation inks by adding a thermally crosslinked layer to the substrate surface.

The thermal initiator is generally selected for high reactivity at sublimation temperatures (typically 175 to 200 degrees C., alternatively 150 to 200 degrees C., alternatively 150 to 250 degrees C., alternatively greater than 150 degrees C., 160 degrees C., 180 degrees C. or 190 degrees C.; or alternatively less than 220 degrees C., 210 degrees C., 200 degrees C., 190 degrees C. or 180 degrees C.) but reasonable stability at ambient temperatures to provide for an acceptable shelf life. Examples of commercially available thermal initiators and their characteristic half-lives at dye sublimation and room temperatures include:

- Dicumyl peroxide: half life=5.4 sec at 200 C, 1400 years at 25 C
- t-butyl peroxybenzoate: half life=1.7 sec at 200 C, 370 years at 25 C
- benzoyl peroxide: half life=0.3 sec at 200 C, 1 year at 25 C Both the selection and concentration of the thermal initiator used in the film are optimized to balance curing speed, the extent of curing, and the uncured film shelf life at typical storage temperatures.

Optionally, a free radical scavenger may be employed as a component in the coated film to prevent or retard premature curing during storage. The concentration of the free radical scavenger with respect to the thermal initiator concentration can also modulate the rate and/or extent of reaction at lamination temperatures.

In some embodiments acrylate monomers and/or oligomers are employed as film components to plasticize the uncured film, provide initial tack to the uncured film, improve adhesion to multiple substrate surfaces, increase sublimation dye receptivity, and/or control crosslinking density in the cured film. Increased crosslinking can impart greater durability, improved water and chemical resistance, though extensive crosslinking may adversely affect dye receptivity.

Pigment can optionally be added as a component in the coated film. White pigment enables true color reproduction on non-white substrates and enables dye sublimation printing on backsides of clear substrates for applications where the printed image will be viewed through the clear substrate.

Nonwhite pigments and particles may be added to impart other visual effects to a dye sublimation printed image. The concentration of pigments and particles may be modified to provide varying levels of opacity, translucency, or other visual effects.

A plasticizer may be employed as a component in the coated film to control brittleness, durability, scratch resistance, or other characteristics.

Other additives may be employed as components in the coated film to adjust, for example, slip/glide, antiblocking, scratch resistance, UV resistance, gloss or other visual or physical characteristics.

The following Figures depict examples of the sequencing of multiple optional film layers where their relative positions impact the performance of the film construction as a whole. Other combinations of functional layers are possible and are not limited to the examples shown.

A carrier film 101, 201, 301, 401, 501 and 601 is comprised of polyethylene terephthalate (PET) or other similarly heat-tolerant material. In the figures and in the descriptions to follow, the carrier will define the bottom face of the overall film construction and any coated layers will be applied to the top face.

Optionally the carrier film may have at least one face treated with a release-control layer (203, 303, 503 and 603) to promote adhesion or to promote release of the dye sublimation-receptive layer (102, 202, 302, 402, 502 and 602 in the Figures), or, for example, to promote adhesion on the top face while promoting release on the bottom face. A release coating may be desirable on the bottom face in formulations in which the topmost face of the construction is tacky.

The carrier film 101, 201, 301, 401, 501, 601 may have a high gloss surface to produce a high gloss dye sublimation-receptive layer 102, 202, 302, 402, 502, 602 upon transfer to a substrate, or may have a matte or otherwise textured surface in order to impart reduced gloss or other embossed surface texture characteristics to the dye sublimation-receptive layer.

The thickness of the carrier film 101, 201, 301, 401, 501, 601 may be adjusted to modulate the embossing of external textures or irregularities during application and curing on a substrate. The thickness of carrier film 101, 201, 301, 401, 501, 601 is typically 4 mils, but may range from less than 2 mils to greater than 6 mils.

A dye sublimation-receptive main layer 102, 202, 302, 402, 502 and 602 is situated above the top face of carrier layer 101, 201, 301, 401, 501, 601. The primary function of the dye sublimation-receptive main layer is to accept and retain gaseous dyes upon printing and is typically comprised of at least a thermally curable resin and thermal initiator. Other components may be included in this layer, as described previously. The main layer may be optically clear or pigmented, and may be applied by any appropriate coating method. The thickness of this layer may be varied to obtain desired performance characteristics, depending on the application.

Optionally a protective layer 304 and 604 in the Figures may be situated above the top face of the carrier film and below the bottom face of the dye sublimation-receptive layer 102, 202, 302, 402, 502, 602. This arrangement places the protective layer on the outermost surface when the film is applied to a substrate. The protective layer is itself either dye sublimation-receptive or permeable to the gaseous dyes and may be thermally curable. The protective layer may be formulated to provide protection against ultraviolet (UV) light, to improve scratch, water or chemical resistance, or a combination of these functions.

Optionally a color/effect layer 405, 505 and 605 in the Figures may be situated above the top face of the main dye sublimation-receptive layer. This arrangement places the color/effect layer below the main layer when the film is applied to a substrate. The color/effect layer may comprise white pigment, colored pigment or visual effect components to impart a reflective, metallic, pearlescent or other visual effect. The color/effect layer may be thermally curable.

Optionally and adhesion layer may be applied as the topmost layer in the film construction to provide temporary or permanent adhesion to a substrate, and may be formulated to optimize adhesion to certain types of substrates. The adhesion layer may be thermally curable.

Optionally a slipsheet 106, 206, 306, 406, 506 and 606 may be situated as the topmost layer of the film construction. The slipsheet may have one or more functions, such as to protect against particulate contaminants, prevent blocking of the film when stacked or rolled and to aid in handling and storage of the film when the topmost coated layer is tacky. The slipsheet may be polyethylene terephthalate, polypropylene, polyethylene or other film and may either be raw or coated with a release coating such as silicone, wax or other materials of similar function.

The function of two or more individually described layers above may be combined into a single layer rather than distinct functional layers. For example, the color/effect layers 405, 505, 605 may be incorporated into the main dye sublimation-receptive layers 402, 502, 602 by blending the color/effect additives into the coating fluid for the main layer. Similarly, one function of the protective layer 304/604 may be incorporated into the main dye sublimation-receptive layer by blending UV blocking additives into the coating fluid for the main layer.

The function and use of the dye sublimation-receptive film construction is as follows in certain embodiments. For flat substrates, an appropriately sized sheet of film is obtained or cut to size from a larger sheet or roll. Slipsheet 706, if present, is removed and the transfer film applied to the surface of substrate 707. The substrate and applied film are placed in a heat press and heated at, for example, 200 degrees C. for an appropriate time, depending on the type, size and thickness of the substrate. After pressing, the substrate and film are removed from the press, cooled, and the carrier sheet 701 is removed. At this point, the dye sublimation-receptive film 702 has cured and hardened to applied film 702*b*. A dye sublimation print transfer sheet with a printed image is placed face-down on the applied film 702*b* and placed into a heat press at, for example, 200 degrees C. for an appropriate time for the type, size and thickness of the substrate to induce dye sublimation and image transfer. After pressing, the substrate with applied film and print transfer sheet are removed from the press, the print transfer sheet removed, and the substrate is allowed to cool, producing a printed image 708 in the area of the substrate which was in contact with the print transfer sheet.

For curved substrates, print transfer follows the same steps as above, but substituting a cylindrical press, heat wrap, or other means of applying heat and pressure for the flat heat press, modifying times as needed for the equipment being used.

Various example formulations were prepared, and described below

Example 1

73.2% Lumicryl U-721S (Estron Chemical)
22.2% methyl ethyl ketone 4.8% benzoyl peroxide solution in methyl ethyl ketone, 4.6 mg/g Example 1 was coated on 4 mil glossy PET film to a dry thickness of 1 mil. The resulting coating was soft and non-tacky. A sample of the film was applied to a 3" square of 1/16" aluminum sheet, the surface of which was prepared by wet sanding with 800 grit sandpaper to produce a surface on which water forms a continuous sheet without beading. The film and substrate were placed in a 400 F heat press with firm contact pressure for four minutes to cure the applied coating. After cooling and removal of the PET film, the transferred coating quality was inspected. In this example, some small areas of incomplete transfer were observed, which was attributed to small air pockets trapped between the substrate and applied film; a high gloss surface finish was observed. A dye sublimation transfer sheet with a printed test image was applied to the substrate and placed in a 400 F heat press for two minutes, after which time the transfer sheet was removed and the substrate was allowed to cool. Inspection of the transferred image quality resulted in acceptable print transfer. The coating on the dye sublimation printed substrate was scored with a tool in a perpendicular crosshatch pattern consisting of ten parallel cuts with 1 mm spacing. The scored substrate was then fully immersed in boiling water for a period of 30 minutes. Following removal from the water, drying and cooling to ambient temperatures, a piece of clear adhesive tape was firmly applied over the crosshatch area, rapidly peeled from the surface and inspected for the presence of any coating that had been removed from the substrate surface. In this example, all or nearly all of the coating in the crosshatch area was removed from the substrate by the tape peel.

Example 1 was coated and tested as above on a matte 3 mil PET film with comparable results, with the exception of a low-gloss matte surface finish.

Example 2

65.4% Lumicryl U-721S
19.7% methyl ethyl ketone
10.6% CN2283 (Sartomer Americas)
4.3% benzoyl peroxide solution, 4.6 mg/g Example 3

67.6% Lumicryl U-721S
20.3% methyl ethyl ketone
7.7% CN2283 (Sartomer Americas)
4.4% benzoyl peroxide solution, 4.6 mg/g Example 4

69.9% Lumicryl U-721S
21.0% methyl ethyl ketone
4.5% CN2283 (Sartomer Americas)
4.5% benzoyl peroxide solution, 4.6 mg/g Examples 2-4 were prepared and coated on 4 mil glossy PET film to a dry thickness of 1 mil. All resulting coatings were soft, with variable levels of tackiness. The coating of Example 2 was aggressively tacky, resulting in difficulty in applying to polished surfaces without trapping air pockets between the substrate and coating, and was not at all repositionable once the film made contact with the substrate surface. The coating of Example 3 provided reduced tackiness, but remained non-repositionable. The coating of Example 4 provided sufficient adhesion to polished surfaces while retaining a reasonable ability to lift and reposition the film to eliminate trapped air pockets.

Example 5

63.1% Lumicryl U-721S
19.0% methyl ethyl ketone
10.3% CN2283
2.6% Genorad 40 (Rahn USA)
4.5% benzoyl peroxide solution, 4.6 mg/g Example 6

63.1% Lumicryl U-721S
19.0% methyl ethyl ketone
10.3% CN2283
2.6% Genorad 41 (Rahn USA)
4.5% benzoyl peroxide solution, 4.6 mg/g Example 7

62.6% Lumicryl U-721S
18.8% methyl ethyl ketone
10.2% CN2283
3.3% PL-2236 (PL Industries)
5.1% benzoyl peroxide solution, 4.6 mg/g Example 8

62.6% Lumicryl U-721S
18.8% methyl ethyl ketone
10.2% CN2283
3.3% PL-2263 (PL Industries)
5.1% benzoyl peroxide solution, 4.6 mg/g Examples 5-8 were prepared, coated, applied to aluminum substrates, cured, printed and tested as detailed in Example 1. Following the boiling water test, Examples 5 and 6 showed significant loss in surface gloss of the coating, as well as extensive bubbling of the coating surface. Both also failed the tape adhesion test. Examples 7 and 8 both retained surface gloss after the boiling water test, with no film bubbling observed. Example 7 produced full adhesion of the film to the surface in the tape peel test, while Example 8 resulted in partial loss of adhesion.

Example 9

61.1% Lumicryl U-721S
18.4% methyl ethyl ketone
9.9% CN2283
3.2% PL-2236
1.0% Tinuvin 123 (BASF) hindered amine light stabilizer
1.5% Tinuvin 1130 (BASF) liquid UV absorber
5.0% benzoyl peroxide solution, 4.6 mg/g Example 10

47.1% Lumicryl U-721S
14.2% methyl ethyl ketone
7.7% CN2283
2.4% PL-2236
9.6% Titanium dioxide
15.3% methyl ethyl ketone (for a total of about 29.5% MEK, the additional MEK used to add the titanium dioxide, which whitens the layer).
3.8% benzoyl peroxide solution, 4.6 mg/g Examples 7, 9 and 10 were coated on 4 mil glossy PET film to a dry thickness of 1 mil. The coating of Example 10 was applied and cured on two prepared samples of aluminum sheet as detailed in Example 1, resulting in fully opaque white coatings. To the first of these substrates, the coating of Example 7 was applied and cured in a heat press for four minutes at 400 F. The coating of Example 9 was applied to the second white substrate under the same conditions. Both of these two-layer substrates, Example 10 plus Example 7 (in which Example 10 and Example 7 are combined one over the other, with the pigmented Example 10 layer underneath the Example 7 layer when applied to a substrate) and Example 10 plus Example 9 (with Example 10 and Example 9 combined one over the other), were imaged by dye sublimation with a color test pattern consisting of converging yellow, magenta, cyan, black and clear color wedges. A commercially available aluminum substrate with dye sublimation-receptive white coating was imaged as an external control sample. Each of these three substrates was exposed to focused light from a xenon arc source for a duration of 10 days, simulating two years of Temperate Zone exposure to sunlight. Following these exposure tests, the samples were inspected and compared for colorfastness of the printed test pattern. The sample of Example 10 plus Example 7 showed evident fading and discoloration of each of the YMCK color wedges; surface gloss was unaffected. The Example 10 plus Example 9 and the external control samples both gave comparable results, with barely perceptible fading of the YMCK color wedges. None of the three samples showed any discoloration, gloss loss or other visible effect in the clear (white) color wedges It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

It should also be noted that, as used in this specification and the appended claims, the phrase "configured" describes a system, apparatus, or other structure that is constructed or configured to perform a particular task or adopt a particular configuration to. The phrase "configured" can be used interchangeably with other similar phrases such as arranged and configured, constructed and arranged, constructed, manufactured and arranged, and the like.

Aspects have been described with reference to various specific and preferred embodiments and techniques. However, it should be understood that many variations and modifications may be made while remaining within the spirit and scope herein. The embodiments described herein are not intended to be exhaustive or to limit the invention to the precise forms disclosed in the following detailed description. Rather, the embodiments are chosen and described so that others skilled in the art can appreciate and understand the principles and practices.

The invention claimed is:

1. A transferable film for dye sublimation, the film comprising:

a carrier film; and a dye sublimation-receptive layer comprising a base resin that undergoes crosslinking at elevated temperatures; and wherein the dye sublimation-receptive layer further comprises a thermal initiator.

2. The transferable film for dye sublimation of claim 1, wherein the dye sublimation-receptive layer comprises an acrylic copolymer with acrylate reactive groups.

3. The transferable film for dye sublimation of claim 1, wherein the dye sublimation-receptive layer is at least 0.5 mils thick.

4. The transferable film for dye sublimation of claim 1, wherein the dye sublimation-receptive layer is less than 5 mils thick.

5. The transferable film for dye sublimation of claim 1, wherein the dye sublimation-receptive layer is from 1 to 2.5 mils thick.

6. The transferable film for dye sublimation of claim 1, wherein the initiator has a half-life of less than 10 seconds at 200 degrees C.

7. The transferrable film for dye sublimation of claim 1, further comprising a pigment in the dye sublimation-receptive layer.

8. The transferrable film for dye sublimation of claim 7, wherein the pigment comprises a white pigment.

9. The transferable film for dye sublimation of claim 1, wherein the carrier film is heat tolerant.

10. The transferable film for dye sublimation of claim 1, wherein the carrier film comprises polyethylene terephthalate.

11. The transferable film for dye sublimation of claim 1, wherein the carrier film has a surface texture for imparting a surface property to the dye sublimation-receptive layer.

12. The transferable film for dye sublimation of claim 11, wherein the surface texture is selected from gloss and matte.

13. The transferable film for dye sublimation of claim 1, wherein the carrier film is from 2 to 6 mils thick.

14. The transferable film for dye sublimation of claim 1, further comprising a release control layer intermediate the carrier film and the dye sublimation-receptive layer.

15. The transferable film for dye sublimation of claim 14, wherein the release control layer increases adhesion between the carrier film and the dye sublimation-receptive layer.

16. The transferable film for dye sublimation of claim 14, wherein the release control layer decreases adhesion between the carrier film and the dye sublimation-receptive layer.

17. The transferable film for dye sublimation of claim 1, further comprising a protective layer between the carrier film and the dye sublimation receptive layer.

18. The transferable film for dye sublimation of claim 1, further comprising an adhesive layer positioned on the dye sublimation-receptive layer.

19. The transferable film for dye sublimation of claim 18, wherein the adhesive layer is thermally curable.

20. The transferable film for dye sublimation of claim 1, further comprising a slipsheet positioned on an outer surface of the transferable film.

21. The transferable film for dye sublimation of claim 1, further comprising a color-effect layer.

22. A method of forming a dye sublimation receptive surface, the method comprising:

a) providing a substrate having a surface that is substantially non-receptive to dye sublimation inks;

b) applying a transfer film comprising a carrier layer and a thermally crosslinkable film containing a thermal initiator to the substrate;

c) applying heat and pressure to the transfer film at a temperature above 175 degrees C.; and d) removing the carrier layer.

* * * * *